United States Patent [19]

Gundrum et al.

[11] Patent Number: 4,574,681

[45] Date of Patent: Mar. 11, 1986

[54] GUN BARREL WEAPON WITH LIQUID PROPELLANT CHARGE

[75] Inventors: Edwin Gundrum, Reiskirchen; Karlheinz Reinelt, Hermannsburg, both of Fed. Rep. of Germany

[73] Assignee: Rheinmetall GmbH, Duesseldorf, Fed. Rep. of Germany

[21] Appl. No.: 480,686

[22] Filed: Mar. 31, 1983

[30] Foreign Application Priority Data

Mar. 31, 1982 [DE] Fed. Rep. of Germany ..... 3211832

[51] Int. Cl.[4] ..... F41F 1/06

[52] U.S. Cl. ..... 89/7; 89/1.3; 89/17

[58] Field of Search ..... 89/1 F, 1 J, 1.703, 89/1.704, 1.705, 7, 17

[56] References Cited

U.S. PATENT DOCUMENTS

| | | | |
|---|---|---|---|
| 315,030 | 4/1885 | Hill | 89/7 |
| 556,058 | 3/1896 | Huey | 89/7 |
| 2,789,467 | 4/1957 | Rosenthal | 89/1 F |
| 4,337,685 | 7/1982 | Mundin et al. | 89/7 |

FOREIGN PATENT DOCUMENTS

| | | | |
|---|---|---|---|
| 80179 | 2/1920 | Austria | 89/1 F |
| 2102310 | 8/1972 | Fed. Rep. of Germany . | |
| 126071 | 5/1919 | United Kingdom | 89/7 |

OTHER PUBLICATIONS

Dadieu-Damm-Schmidt, Raketantreibstoffe, Rheinmetall Buecherei, §6.4–6.4.1.4.

M. Barrere, Raketenantriebe, Elsevier Publishing Co., 1961, pp. 450–453.

*Primary Examiner*—Stephen C. Bentley

[57] ABSTRACT

A gun barrel weapon for firing a projectile by means of a liquid propellant medium. The weapon includes a coaxial first member which defines a propellant medium combustion chamber. This first member also functions as a breech or breech block. A second member defining a projectile chamber is disposed between the first member and the gun barrel. The combustion chamber is adapted to hold a liquid propellant medium and includes a neck portion of narrowed cross-section which throttingly communicates with the projectile chamber. The first member also includes a plurality of through-bores which form conduits between the projectile chambers and the combustion chamber.

6 Claims, 6 Drawing Figures

GUN BARREL WEAPON WITH LIQUID PROPELLANT CHARGE

BACKGROUND OF THE INVENTION

Gun barrel weapons of the type described in German published application No. DE-OS 21 02 310 are well-known and utilize a propellant charge requiring no cartridge casing which is axially slidably and/or helically shaped so as to be axially movable in the weapon. This propellant charge having no cartridge casing includes a propellant medium combustion chamber in ellipsoidal form adapted for high cadence firing of projectiles. There is also described in an article entitled "Raketenantrieb" (rocket propulsion) by M. Barrere, Elsevier Publishing Company 1961/page 450 known combustion chamber forms which, when used with gun barrel weapons, with liquid propulsion medium can cause with unfavorable burning of the propulsion medium an incomplete combustion. This occurs because the high pressure combustion chamber which is equipped with pressurizing means there occurs, after combustion ignition, a blocking of the exit opening of the combustion chamber, whereby the progressing reaction is interrupted or inhibited so that at simultaneous projectile movement it can again restart and the process can be cyclically repeated. Due to the non-uniform combustion there remain unburned propellant material remnants in the chamber. As a result of the thereby simultaneously occurring strong pressure oscillations an unstable projectile flight can occur.

SUMMARY OF THE INVENTION

It is a general object of this invention to provide a gun barrel weapon of the afore-described type in which the drawbacks hereinabove described of the state of the art have been eliminated or mitigated. The gun barrel weapon of the invention operates preferably with liquid propellant material and includes a propellant medium combustion chamber of simple construction which is adapted to function securely automatically and continuously. The gun barrel weapon is constructed in such a way that a complete combustion of the propellant medium with a uniform combustion and the gas pressure in the pressure-time-burning diagram receives a plateau-like performance-increasing course.

The invention makes it possible to throttle a propellant medium combustion chamber by providing it with surrounding channels and thereby provide a conduit with the projectile chamber disposed at the exit side, whereby, for example, by using a monergolic liquid propellant material a residue-free complete combustion of the liquid propellant material is achieved with a uniform cumbustion in the pressure-time-burning diagram.

A residue-free combustion with a uniform burning of the liquid propellant substances can, for example, already be attained when the inner space of the propellant medium combustion chamber is joined to the projectile chamber by means of connecting surrounding channels which are simultaneously parallel and also may have an equal or different inclinations with respect to the longitudinal gun barrel axis. A variable shape for the channels permits a favorable modulating with respect to the spatial conditions of the propellant medium combustion chamber.

It has been ascertained that with a propellant medium combustion chamber which has a reduced cross-section at the exit side the liquid propellant medium can be caused to be particularly performance-increasing when the propellant medium combustion chamber, which has a region forming a breech, which is pear-shaped, preferably shaped as a bottom member defining a semi-spherical shaped cavity and extends up to the exit opening and is there frusto-conically reduced. In such an arrangement the advantages flowing from, for example, monergolic liquid propellant material and the propellant medium combustion chamber become particularly evident because, on the one hand, a gas-pressure development with defined plateau-effect is achieved and, on the other hand, the propellant material mixture, due to the reduced toxic properties, is advantageously suitable in particular because it can be easily handled; the liquid propellant material is quickly available even in large quantities. On the other hand, the propellar medium combustion chamber, because of its geometry, furnishes an optimum propellant material combustion and can be simply manufactured due to its manufacturing technical characteristics in a cost-effective manner.

In order to avoid a clogging of the propellant material in the neck of the propellant medium combustion chamber and for a more rapid and reproducible surface formation the throttling means includes at least, preferably twelve channels, having equal or different cross-sections.

According to a further feature of the invention the propellant medium combustion chamber can, as a result of manufacturing-favoring characteristics, with certain predetermined geometrical size relationships of the propellant medium combustion chamber, be made also, for example, of two parts.

The invention furnishes for the loading operation a plurality of alternate embodiments. In one of such embodiments the propellant medium combustion chamber can be moved laterally with respect to the longitudinal gun barrel axis to such an extent that for the following firing a further projectile can be fed into the rear of the gun barrel. In another alternate embodiment a plurality of shots in a direct sequence can be achieved by providing a revolver-like projectile chamber construction, which is operative between the gun barrel and the propellant medium combustion chamber construction, whereby via a thereto connected computer-controlled dosing station the range and cadence of the firing burst can be pre-programmed.

The invention makes it advantageously possible to maintain the gun barrel weapon in a fire-ready condition even when the gun elevation is horizontal or negative by using a diaphragm which prevents the spilling of the liquid propellant material.

A further feature of the invention resides in that, starting with an arrangement of a plurality of propellant medium combustion chambers, which are arranged on a common or separate platforms in identical or different planes, a plurality of gun barrel weapons with different projectile calibers can be operated simultaneously or sequentially.

BRIEF DESCRIPTION OF THE DRAWING

The invention will be more readily understood by reference to the accompanying drawings showing preferred embodiments of the invention.

FIG. 5 is an elevational view of an alternate embodiment of the invention wherein a plurality of propellant medium combustion chambers are arranged within one weapon for a plurality of gun barrels mounted on a common platform, whereby the right half of FIG. 5 represents a sectional view along the plane 5—5 of FIG. 4, wherefore the gun barrel, projectile chamber and propellant medium combustion chamber are illustrated in cross-section; and FIG. 6 is a partial longitudinal sectional view through a gun barrel and a propellant medium combustion chamber forming a further embodiment of the invention having external return conduits.

DETAILED DESCRIPTION

Figure 1:
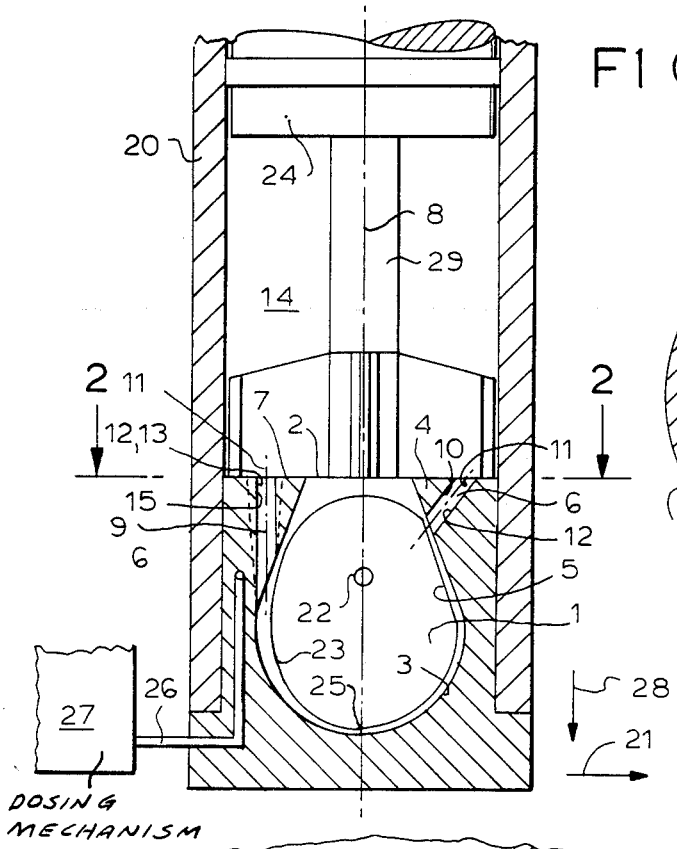
FIG. 1 is a partial sectional view of a gun barrel weapon in accordance with this invention having an undivided propellant medium combustion chamber.
Figure 2:
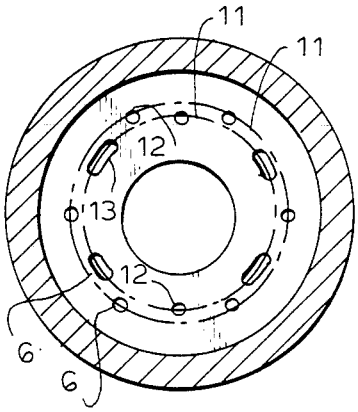
FIG. 2 is a section along plane II—II in FIG. 1 through the gun barrel showing the arrangement of bores in the propellant medium combustion chamber.

There is illustrated in FIG. 1 a gun barrel 20 in which there is disposed a propellant medium combustion chamber 1 which functions as a part of a breech block. Also there is illustrated detail of a projectile 24 having flight stabilization means 29. In order to achieve an optimum residue-free propellant medium combustion when using, for example, a monergolic liquid propellant medium, there is provided a space-saving propellant medium combustion chamber-configuration which includes a pear-shaped configuration including a semisphere 3 and a reduced damming or throttling portion 4 which is of frusto-conical shape, whereby the inner surface 5 of the throttle 4 is joined via channels 6 with the outlet 7 of the propellant medium combustion chamber 1 so as to have a direct communication with the projectile 24. The channels 6 which are disposed along a plurality of concentric circles 11 are arranged in such a way that some of them (those having longitudinal axes 9) are parallel to the longitudinal axis 8 of the gun barrel and others have an identical or different inclination with respect to the same longitudinal axis 8 of the gun barrel. By simultaneous adaptation to the size-relationship of the combustion chamber-geometry, there can be at least two and preferably twelve channels 6 at once arranged as cylindrical bores 12 within a diameter region of 6 mm to 18 mm, whereby the bores 12 can also be of conical shape 15 and/or have further hollow profiled cross-sections, for example, be in the form of longitudinal holes 13, which can be used not only for facilitating the manufacturing, but also for purposes of increasing the flow of the liquid propellant material flowing through the pressure-relieve channels into the projectile chamber 14 and to thereby facilitate its combustion. The channels 6 can thereby be arranged on a plurality of concentric circles, as has been indicated with respect to FIG. 2.

As a result on the machined channels 6 the propellant medium combustion chamber surface is enlarged, so that in a relatively short period of time a pressure compensation between the inner chamber 1 of the propellant medium combustion chamber and the projectile chamber 14 disposed outside of the combustion chamber 1 can result. Thereby the so-called "coughing" of a combustion chamber motor within the propellant medium combustion chamber is prevented and uniform burning is achieved. In order to obtain a uniform injection of the liquid propellant medium there is provided a lead-in nozzle 22 which leads into the propellant medium combustion chamber 1 in a tangential direction, which inlet may be positioned within the region 4 of the propellant medium combustion chamber or, for example, below the upper edge of the hemisphere 3. The dispensing characteristics of the nozzle 22 are controlled by means of an automatic dosing mechanism 27, whereby the range and the cadence of the fire bursts can be preprogrammend. The propellant medium combustion chamber 1 is capable of being displaced away from and laterally relative to the gun barrel in the direction of the arrows 21 and 28 into an inoperative position by non-illustrated hydraulic and pneumatic actuating means for the purpose feeding a further projectile for a subsequent firing into the ready to be fired position within the gun barrel.

When firing a horizontal shot or when tilting the gun barrel into a negative gun elevation position means are provided for preventing an inhibiting of the uniform burning of the liquid propellant medium. This is achieved by means of an combustible diaphragm 23 disposed within the propellant medium combustion chamber 1 by means of which the liquid propellant medium is retained within the combustion chamber and its spilling out is prevented. In order to be able to produce a propellant medium container by means of the diaphragm 23, it is necessary, to arrange a further nozzle around the nozzle 22, whereby the propellant medium filling is enclosed directly by the diaphragm during the injection process.

Figure 3:
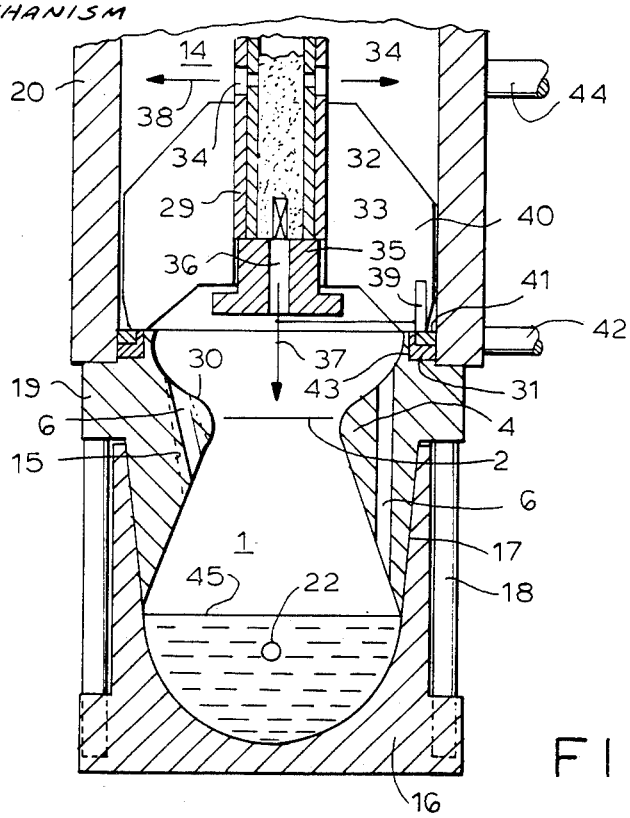
FIG. 3 is a partial sectional view through a gun barrel of an alternate embodiment of the invention having an ignition arrangement and a divided combustion chamber.

There is illustrated in FIG. 3 a propellant medium combustion chamber 1 having a divided housing, the exterior region 17 of which defines the constricted neck portion 4 which is encompassed by the bottom member 16 with its inner hemispherical chamber and is mounted thereon by means of a flange ring 19 integral therewith by fastening means 18, for example screws. The flange ring 19 forms thereby a rigid unit which is coaxially and centrally mounted relative to the gun barrel 20. The constricted neck portion 4 which is joined to the flange ring 19 is constructed in such a way that the channels 6 are open upwardly relative to the exit opening 2 in a transfer portion 30 which flares outwardly with respect to the projectile chamber 14 and has rounded edges, whereby the end of the transfer portion 30 which confronts the gun barrel 20 includes an annular groove 31 for receiving a gasket ring or other sealing means 43.

In the embodiment of FIG. 1 the nozzle 22 leading into the propellant medium combustion chamber 1 also tangentially injects the liquid propellant medium via an automatic dosing mechanism 27. Similar to the arrangement illustrated in the embodiment of FIG. 1 the dividable propellant medium combustion chamber 1 can be moved laterally away from the gun barrel 20 by a non-illustrated hydraulic-pneumatic actuating mechanism.

The ignition of the liquid propellant medium results by means of an emission charge 32 disposed in the flight stabilizing arrangement 29 of the projectile, which in its turn is ignited by means of an ignition fuse 33. An insulated contact wire for the ignition fuse 33 leads outwardly via an insulated contact shoe 39 mounted on the flight stabilization mechanism 40 as well as two further contacts 41 and 42, whereby the contact 41 is mounted in a sealing means 43 which is disposed within the recess 31. In lieu of an electrical ignition effected via the contacts 39, 41, 42, the ignition charge 32 can be ignited mechanically via an ignition arrangement 44 directly through the bores 34, radially disposed in the flight stabilization mechanism 29 of the projectile. In addition to the bores 34 extending in a radial direction there is provided a bore 36, through which, after the resulting ignition initiation, the hot powder gases of the ignition charge exit in an axial direction 37 and in a radial direction 38. At simultaneous pressure increase in the propellant medium combustion chamber 1 the burning first of all occurs at the top surface 45 of the liquid propellant medium. As a result of the pressure increase in the propellant medium combustion chamber 1 by means of the gas stream which expands in the axial direction, the liquid propellant medium moves towards the nozzle-shaped exit opening 2 while forming droplets and increasing its surface area by spreading over the combustion chamber inner wall surfaces. While the ignition initiation of the liquid propellant medium results directly in the axial direction via the bore 36 disposed within the ignition fuse screw 35, the liquid propellant medium material outstreaming via the channel 6 into the projectile chamber 14 is combusted by the ignition charge disposed in the flight stabilization mechanism 29 flowing through the bores 34.

Figure 4:
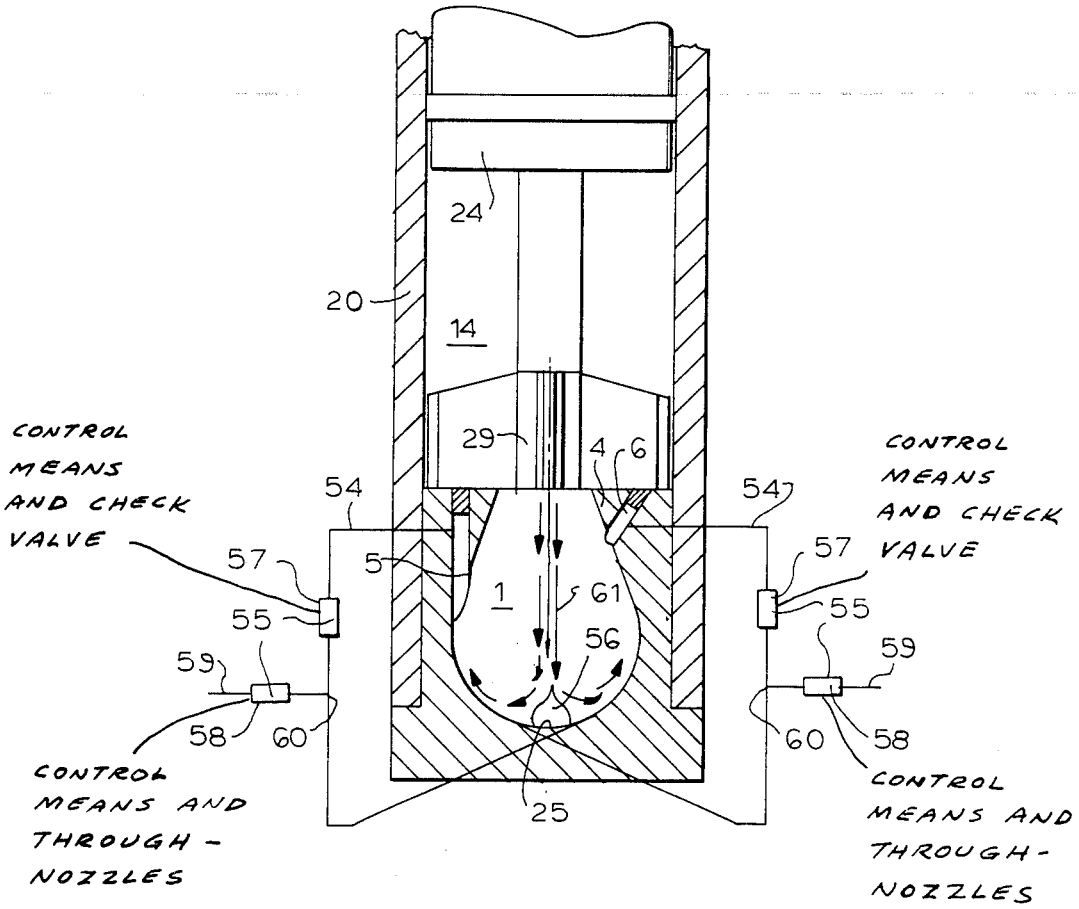
FIG. 4 is a plan view along plane 4—4 of FIG. 5 wherein a multiple projectile chamber construction is disposed between the gun barrel and the propellant medium combustion chamber.

There is illustrated in FIG. 4 a projectile chamber 46 which, similar to the projectile chambers of a revolver, is mounted between the gun barrel and the propellant medium combustion chamber and is rotatable about an axis 50. In this arrangement the projectile chambers 52 are uniformly spaced from each other about a circle 51 (for example four projectile chambers 52), whereby the numbers of projectile chambers 52 can be varied simply by exchanging the projectile chamber unit 46. This arrangement makes possible to sequentially place in operative firing position a plurality of projectiles.

The right half of FIG. 5, which is in cross-section, illustrates how the projectile chamber member 46, which is rotatable in the direction of the arrow 53 about the axis 50, can place sequentially individual projectile chambers 52 in firing position between the gun barrel 20 and the propellant medium combustion chamber 1 so that all three parts are in alignment with the longitudinal gun barrel axis 8. A housing of the propellant medium combustion chamber 1 abuts, when so aligned, with the projectile chamber 46 and can be at the same time itself mounted on a platform 47. The nozzle 22 is connected in a non-illustrated manner to the automatic dosing mechanism which in its turn is connected to a non-illustrated computer control mechanism for purposes of injecting a dosed amount of liquid propellant medium into the propellant medium combustion chamber 1. The region 49 on the exit opening 2 which is disposed between the end of the constricted neck portion 4 and the rounded transfer portion 30 is cylindrical in shape, whereby the burning characteristics and the streaming conditions are favored.

The left half of FIG. 5 illustrates a further housing of a propellant medium combustion chamber and a projectile chamber member 46 rotatable about the axis 50 for purposes of bringing into firing position the projectile in alignment with the gun barrel axis 8 of the gun barrel 20. Both gun barrel weapons, which can be of different caliber, are mounted on a common flat platform 47. With further, non-illustrated embodiments, a plurality of gun barrel weapons are mounted on separate platforms 47 which are disposed on a common plane 48 or can be differently inclined with respect to such common plane 48. In FIG. 6 there is illustrated an embodiment which corresponds substantially to that of FIG. 1. A gun barrel 20 having an undivided propellant medium combustion chamber 1 has a projectile 24 mounted therein the tail of which includes an ignition charge 32 (see FIG. 3). The chananels 6 of the constricted neck portion 5 are closed in a direction toward the projectile chamber 14. However, via a return conduit 54 a return flow of the still incompletely combusted propellant medium to a region opposite and removed from that of the exit opening 2 of the lower region of the propellant combustion chamber 1 is possible. During combustion additional liquid propellant medium can be dosingly supplied via control means 55 into the ensueing circulating stream, so that in dependence with the prevailing desired firing range the plateau-shaped course of the burning curve in the pressure-time-diagram can be varied with optimum propellant medium use. The dosing of the additional propellant medium can advantageously be carried out by means of a through-nozzle 58 mounted on the supply conduit 59, whereby for maintaining the circulation a check valve 57 can be mounted between the conduit joint 60 of the return conduit 54 and the supply conduit 59, on the one hand, and the channel 6 on the other hand. The number of adjustable through-nozzles 58 can be adjusted to the number of return conduits 54, whereby an omission of the nozzle 22 (FIG. 1) makes possible the feeding of separate components of a hypergolic propellant medium. A distribution tongue 56 is disposed within the propellant medium combustion chamber 1 but reduced charge masses for a central distribution of the firing stream 61 emanating from the flight stabilization mechanism 29 at the points 25, whereby as a result of this distribution tongue the return conduits 54 do not exit at the point 25 but are positioned at a point adjoining the outer periphery of the distribution tongue 56 and are directed in a tangential direction into the propellant charge combustion chamber 1.

There has been described advantageously in the foregoing specification that the propellant medium combustion chamber in accordance with the invention, in contradistinction to the propellant medium combustion chambers of the state of the art, distinguishes itelf by a uniform plateau-like combustion and a complete combustion of, for example, monergolic liquid propellant medium while functioning at an optimum effective degree.

By taking into consideration particular chemical and physiological influences the combustion medium combustion chamber is also suitable for use with hypergolic propellant material and does not exclude the use of other propellant compositions which are solid or gaseous.

Although the invention is described and illustrated with reference to a plurality of embodiments thereof, it is to be expressly understood that it is in no way limited to the disclosure of such preferred embodiments but is capable of numerous modifications with the scope of the appended claims.

We claim:

1. An improved gun barrel weapon having a liquid propellant charge chamber in axial alignment with a projectile chamber and the gun barrel of the weapon, said chamber having a substantially pear-shaped axial cross-section, a first region of said chamber which is remote from said projectile chamber being substantially semi-spherical in shape, and a second region of said chamber which adjoins said first region forming a constriction which is substantially frusto-conical in shape, said second region confronting the rear end of said projectile chamber, the improvement comprising, a housing in which said propellant chamber is mounted, a plurality of communication channels in said housing extending from said second frusto-conically shaped region to said projectile chamber and being disposed around said constriction, the inlet openings of said communicating channels being disposed on the surface of said frusto-conically shaped constriction.

2. The improvement in a gun barrel weapon having a liquid propellant charge chamber as set forth in claim 1, including at least two communicating channels.

3. The improvement in a gun barrel weapon having a liquid propellant charge chamber as set forth in claim 2, including 12 communicating channels being equi-angularly disposed about said constriction in said housing.

4. The improvement in a gun barrel weapon having a liquid propellant charge chamber as set forth in claim 3, wherein said communicating channels are cylindrically shaped and have internal diameters ranging from 6–18 mm.

5. The improvement in a gun barrel weapon having a liquid propellant charge chamber as set forth in claim 2, wherein at least one communication channel has a non-cylindrical cross-section in a plane transverse to the longitudinal axis of the gun barrel.

6. The improvement in a gun barrel weapon having a liquid propellant charge chamber as set forth in claim 5, wherein at least one first communicating channel has a circular cross-section and at least one second communicating channel has a non-circular cross-section in a plane transverse the longitudinal axis of the gun barrel, said first and second communicating channels being disposed on a circle which is coaxial with the longitudinal axis of the gun barrel.

* * * * *